United States Patent [19]
Babad et al.
[11] 4,229,317
[45] Oct. 21, 1980

[54] METHOD FOR IMMOBILIZING RADIOACTIVE IODINE

[75] Inventors: Harry Babad; Denis M. Strachan, both of Richland, Wash.

[73] Assignee: The United States of America as represented by the United States Department of Energy, Washington, D.C.

[21] Appl. No.: 966,522

[22] Filed: Dec. 4, 1978

[51] Int. Cl.[2] ..... G21F 9/16
[52] U.S. Cl. ..... 252/301.1 W; 106/63; 106/69; 423/249; 423/328
[58] Field of Search ..... 252/301.1 W; 423/249, 423/328; 106/63, 69

[56] References Cited

U.S. PATENT DOCUMENTS

| | | | |
|---|---|---|---|
| 4,020,147 | 4/1977 | Shidlovsky | 423/328 |
| 4,028,265 | 6/1977 | Barney et al. | 252/301.1 W |

OTHER PUBLICATIONS

Barrer et al., "Chemistry of Soil Minerals," *J. Chem. Soc.* (*A*), 1970, pp. 1516–1523.

*Primary Examiner*—Deborah L. Kyle
*Attorney, Agent, or Firm*—James E. Denny; Frank H. Jackson; James W. Weinberger

[57] ABSTRACT

Radioactive iodine, present as alkali metal iodides or iodates in an aqueous solution, is incorporated into an inert solid material for long-term storage by adding to the solution a stoichiometric amount with respect to the formation of a sodalite ($3M_2O.3Al_2O_3.\ 6SiO_2.2MX$, where M=alkali metal; $X=I^-$ or $IO_3^-$) of an alkali metal, alumina and silica, stirring the solution to form a homogeneous mixture, drying the mixture to form a powder, compacting and sintering the compacted powder at 1073 to 1373 K (800° to 1100° C.) for a time sufficient to form sodalite.

3 Claims, No Drawings

METHOD FOR IMMOBILIZING RADIOACTIVE IODINE

CONTRACTUAL ORIGIN OF THE INVENTION

The invention described herein was made in the course of, or under, a contract with the UNITED STATES DEPARTMENT OF ENERGY.

BACKGROUND OF THE INVENTION

This invention relates to a method of incorporating radioactive iodine into an inert solid material for long-term storage.

One of the concerns of the nuclear energy program is the recovery and storage of radioactive iodine from various liquid and gaseous process streams to prevent its entry into the environment and potential damage to human and animal life. Chemical species which contain radioactive iodine include inorganic species such as elemental iodine and organic species such as methyl iodide. These may be present in reactor containment vesels from normal reactor operation and in particular in the case of fuel element cladding failure. They are also present in waste gas streams from fuel element dissolver operations in nuclear fuel reprocessing plants and in the aqueous waste streams resulting from the fuel reprocessing. Radioiodine is formed in the nuclear reactor fuel by the fission of the fuel material. Although there are other radioactive isotopes of iodine, only $^{129}I$ ($t_{\frac{1}{2}}=1.7\times10^7$ yrs) has a very long half-life. Therefore long-term storage must be provided for this isotope.

A number of processes have been developed for the recovery of radioactive iodine from the off-gas streams of a fuel reprocessing plant. Caustic scrubbing has been used at several reprocessing plants, but has been found ineffective for the removal of organic iodides. A mercuric nitrate - nitric acid scrub system (Mercurex process) which employs a recirculating solution through a packed tower has also been used. However, the system produces substantial volumes of waste and no suitable methods have been developed for removing the iodide as a solid, reducing waste volume and recycling the mercury. The removal of iodine species from a gas stream that employs nitric acid as the liquid scrubbing medium in a bubble-cap tower is also under development (Iodex process). The process effectively removes all iodine species and oxidizes them to a nonvolatile iodate form. This process is advantageous in that the iodine wastes as $HI_3O_8$ can be concentrated and disposed of directly in metal canisters or incorporated into a cement matrix in the form of barium iodate. Off-gas containing the iodine species can also be passed through a silver-exchanged zeolite where the iodine reacts to form chemisorbed silver iodate. Because of the high cost of silver and its value as a resource, the iodine should be removed and the silver-exchanged zeolite regenerated by using hydrogen to carry the iodine to less expensive lead-exchanged zeolite for long-term storage.

However, none of the processes completely solve the problem of immobilizing the radioactive iodine for long-term storage. For example, containers of radioactive material ultimately corrode, releasing any soluble or volatile material to the environment. Cement is subject to leaching and will eventually release the radioactive material. Thus none of the state of the art processes have been demonstrated to be suitable for terminal storage or disposal of radioactive iodine because of their instability, solubility or dispersivity. Conversion of the radioiodine to a monolithic insoluble form of low surface area suitable for emplacement in either geological storage or other long-term disposal facility is necessary.

SUMMARY OF THE INVENTION

We have developed a process whereby the radioactive iodine is incorporated into an inert solid material for long-term storage which overcomes most of the hereinbefore described problems of the present methods. By the method of our invention, the radioactive iodine which is present as alkali metal iodides and/or iodates in an aqueous solution is incorporated into an inert solid material by adding to the solution a stoichiometric amount, with respect to sodalite ($3M_2O.3Al_2O_3.6SiO_2.2MX$, where M=alkali metal; $X=I^-$ or $IO_3^-$) of an alkali metal, alumina and silica, stirring the solution to form a homogeneous mixture, drying the mixture to a powder, and compacting and sintering the powder or hot pressing the powder at 1073 to 1373 K (800° to 1100° C.) and 6.9 to 17.2 MPa (1000 to 2500 psi) for a time sufficient to form a sodalite. The alkali metal is preferably sodium, potassium or a mixture thereof and may be added as a hydroxide while the alumina and silica may be added as a kaolinic clay. Alternately, the alkali metal and alumina may be added together as an alkali metal aluminate while the silica is added as a sol.

It is therefore the object of the invention to provide a process for incorporating radioactive iodines into an inert solid material for long-term storage.

DETAILED DESCRIPTION OF THE PREFERRED EMBODIMENT

It is the purpose of the present invention to provide a material into which the radioactive iodine can be incorporated which is similar to that of naturally occurring sodalite ($3Na_2O.3Al_2O_3.6SiO_2.2NaCl$) with the exception that the chlorine is replaced by the radioactive iodine and that any or all of the sodium may be replaced by potassium. This produces a material which is inert and stable and which has a low leach rate so that the material may be stored in geological formations for long periods of time with little loss of the radioiodine to the surrounding environment.

The aqueous solution of sodium or potassium iodide and/or iodate may be readily prepared from any of the processes hereinbefore enumerated for recovering iodine from off-gas streams with the exception of the mercury process. For example, the HI recovered from silver-exchanged zeolite may be bubbled through a solution of sodium or potassium hydroxide. The $HI_3O_8$ recovered from the Iodex process could be dissolved in sodium or potassium hydroxide. Iodine which has been recovered using nitric acid will have to be neutralized and any nitrates present removed to prevent oxidation of the $I^-$ to the more volatile $I_2$ during heating. Any radioiodine in a solid form can be readily dissolved in an alkali metal hydroxide. The concentration of iodine in the aqueous solution is not critical nor is the concentration of alkali metal since these can be adjusted for when adding the other constituents for preparing sodalite.

To this solution is added a stoichiometric amount or a slight excess of alkali metal, alumina and silica to form iodide or iodate sodalite. These may be added as several different compounds in order to obtain the stoichiometric quantities necessary to prepare the sodalite. For example, the alkali metal may be added to the solution as the hydroxide while the alumina and silica can be added together as a hydrated kaolinic clay. Alternately, the alkali metal and alumina can be added together as an alkali metal aluminate while the silica is added as a sol.

It is important that the aqueous solution containing the compounds to make sodalite be stirred well to form a homogeneous mixture of the compounds in order to ensure the formation of sodalite and because it helps to reduce iodine volatility during the heating step. After the homogeneous mixture is formed, the solution is dried to form a powder, preferably with the application of heat. The dried homogeneous powder can then either be hot pressed or compacted and sintered for a time sufficient to form sodalite. Hot pressing at 6.9 to 17.2 MPa (1000 to 2500 psi) with a die body temperature of 1073 to 1373 K (800° to 1100° C.) was adequate to form a sodalite having greater than 90% of the theoretical density while cold pressing and sintering at the same temperature will provide similar results. Care should be taken to prevent a temperature which is too high to prevent volatilization of the iodine.

EXAMPLE I

To a solution containing 26.02 g NaI and 20.8 g NaOH (27.4 ml 19 M NaOH) was added 67.17 g KCS Kaolin Clay (Georgia Kaolin Co.) and the resulting mixture thoroughly mixed. The solution was allowed to stand for 16 hours and evaporated to dryness in an oven at 100° C. The resulting product was hot pressed at 1080° C. (die surface temperature) at 2000 psi ram pressure to form iodide sodalite. Upon testing, the sample was found to contain 12.7% iodine and the product density was found to be 2.45 g/cm$^3$ which is greater than 90% of the theoretical density. The 96 hour leach rate for this material at room temperature was found to be about $2.62\times10^{-6}$ kg/m$^2$.s [$(2.9\times10^{-5}$ g/(cm$^2$.day)] based on analysis for iodine. This leach rate was comparable to that of the average leach rate for glass. A Soxhlet leach test at 100° C. was also made and was determined to be $6.4\times10^{-4}$ kg/(m$^2$.s) [$7.0\times10^{-3}$ g/(cm$^2$.day)] based on the analysis for iodine and on sample mass loss.

EXAMPLE II

To 30 ml $H_2O$ was added 4.27 g $NaAlO_2$ followed by 2.6 g NaI. The resulting solution has a pH of 11.7. To this was added 7.8 g Ludox As-40® which is a 30% solution of colloidal silica stabilized with ammonia and the solution heated and stirred. A gel formed which was then dried at about 343 K (70° C.). The resulting powder was hot pressed at 1173 K (900° C.) and 13.8 MPa (2000 psi) to form sodalite.

EXAMPLE III

Another sample was made similar to the above except that 3.7 g $KIO_3$ was added in place of the NaI. The resulting powder was hot pressed under the same conditions to achieve an iodate sodalite.

It will be noted that no attempt at optimizing conditions under which this process should be carried out was made. Although the tests showed operability of the invention, it is clear that further attention to the composition of the material and the conditions of the process would result in an improved product.

The embodiments of the invention in which an exclusive property or privilege is claimed are defined as follows:

1. A method of incorporating radioactive iodines, present as sodium or potassium iodides or iodates in an aqueous nitrate-free solution, into an inert, solid material suitable for long-term storage comprising:

adding an effective amount of alumina, silica and an alkali metal selected from the group consisting of sodium and potassium to the solution for the formation of a sodalite;

stirring the solution to form a homogeneous mixture;

drying the mixture to form a powder; and compacting and heating the powder to at least 6.9 mPa at 1073 to 1373 K (800° to 1100° C.) for a time sufficient to form an inert solid sodalite compact suitable for long-term storage.

2. The method of claim 1 wherein the alumina and silica are added as a hydrated kaolinic clay and the alkali metal is added as a hydroxide.

3. The method of claim 1 wherein alkali metal and alumina are added as an alkali metal aluminate and the silica is added as a sol.

* * * * *